US005664739A

United States Patent [19]

Black et al.

[11] Patent Number: 5,664,739

[45] Date of Patent: Sep. 9, 1997

[54] ROTATABLE HANDLE FOR DISPOSAL SPOOL

[76] Inventors: Wesley F. Black, 2402 15th Ave. West; Robert J. Black, 2114 8th Ave. East; Ronald L. Black, 2311 17th Ave. West, all of Williston, N. Dak. 58801

[21] Appl. No.: 608,260

[22] Filed: Feb. 28, 1996

[51] Int. Cl.[6] ..... B65H 75/40

[52] U.S. Cl. ..... 242/588.2

[58] Field of Search ..... 242/405, 405.1, 242/405.2, 405.3, 407, 407.1, 578, 578.2, 588, 588.2, 607, 609, 609.1, 610.6, 613, 613.1

[56] References Cited

U.S. PATENT DOCUMENTS

| | | | |
|---|---|---|---|
| 109,318 | 11/1870 | Holman . | |
| 472,593 | 4/1892 | Tache . | |
| 542,564 | 7/1895 | Koerner . | |
| 560,925 | 5/1896 | Pflueger . | |
| 686,456 | 11/1901 | Huebner . | |
| 851,770 | 4/1907 | Nichols . | |
| 908,743 | 1/1909 | Cavell . | |
| 1,212,376 | 1/1917 | McNamara . | |
| 1,579,886 | 4/1926 | Oxner . | |
| 1,696,056 | 12/1928 | Proctor . | |
| 2,366,755 | 1/1945 | Rogne . | |
| 2,992,789 | 7/1961 | Sardeson | 242/607 |
| 3,195,721 | 7/1965 | Weckesser | 242/588.2 |
| 3,652,027 | 3/1972 | Wong | 242/396.2 |
| 4,179,081 | 12/1979 | Parry | 242/588 |
| 4,248,392 | 2/1981 | Parry | 242/588 |
| 4,285,477 | 8/1981 | Oxendahl et al. . | |
| 4,575,020 | 3/1986 | Strout et al. | 242/588 |
| 4,600,163 | 7/1986 | Hummel et al. | 242/588 |
| 4,601,440 | 7/1986 | Wang | 242/396.4 |
| 5,094,395 | 3/1992 | Lambert | 242/588.2 |
| 5,280,869 | 1/1994 | Ricci | 242/588.2 |
| 5,453,152 | 9/1995 | Mazzola et al. | 242/588.2 |

FOREIGN PATENT DOCUMENTS

| | | | |
|---|---|---|---|
| 355735 | 7/1922 | Germany | 242/588.2 |

*Primary Examiner*—John P. Darling
*Attorney, Agent, or Firm*—James R. Young, Chrisman, Bynum & Johnson, P.C.

[57] ABSTRACT

A line reel for dispensing string, construction line, or cord includes a cap that can be inserted into one end of a spool holding the material to be dispensed, a midsection that can be inserted into the other end of the spool, and a rotatable handle connected to the midsection on the opposite side from the spool. In one embodiment, the cap and midsection frictionally engage the inside of the spool and can be pulled out of the spool for re-use with another spool. In an alternate embodiment, a latch structure on the cap and midsection latches the cap to the midsection in the spool so they cannot be easily removed from the spool once assembled. The line reel includes a notch to hold the free end of the construction line or string. The cap, spool, and midsection, while positioned structurally so that they do not rotate in relation to each other, are able to rotate in relation to the handle to facilitate dispensing the construction line.

23 Claims, 9 Drawing Sheets

ROTATABLE HANDLE FOR DISPOSAL SPOOL

BACKGROUND OF THE INVENTION

1. Field of the Invention

The invention relates to construction line reels, and more particularly, to a construction line reel on which a disposable spool holding wound construction line can be mounted and, when the line is expended or no longer useful, separated from the spool and used with a replacement spool of new line.

2. Description of the Prior Art

Construction workers, including carpenters, masonry workers, steel workers, and the like are frequently required to use long lengths of heavy string, hereinafter referred to as construction line, pulled tight between various points in order to establish straight lines. Straight lines are often necessary to aide in taking measurements or to properly align structural elements during construction. Since the use of a line reel for construction may subject the line reel to numerous environmental and operational hazards and conditions, the line reel must be rugged and capable of withstanding harsh use and treatment. Therefore, an inexpensive, rugged, and easy to use line reel for dispensing construction line is needed. Furthermore, many construction tasks are performed at high heights in partially completed structures where construction equipment, construction materials, and other workers may pose obstacles or hazards to the worker attempting to dispense the construction line, causing dangerous working conditions where the worker must be particularly careful and constantly alert. Therefore, it is desirable that the line reel be capable of being easily held and used with one hand, instead of requiring two, so that the construction worker will be able to focus his attention on maintaining his or her safety. These and other problems and concerns relating to use of construction line are described in more detail in the U.S. Pat. No. 4,285,477, issued to Oxendahl et al., which is incorporated herein by reference.

The construction line reel that is the subject of the U.S. Pat. No. 4,285,477, issued to Oxendahl et al. solved many of the problems described above. However, after the line is cut a number of times, tangled in knots, or just worn out, it has to be replaced. Since construction line is often purchased prewound around a cardboard or plastic spool, it would have to unwound from the spool and wound onto the reel, which is a time consuming and sometimes frustrating task. Therefore, construction workers often prefer to just throw away the old line with the spool and all and just start with a new reel that already has new line on it. That approach works, but it is somewhat wasteful. Further, it does not solve a similar problem in manufacturing, wherein the line has to be unwound from spools and wound onto the reels. While this task can be automated and is easier than a construction worker doing it by hand, it is still a manufacturing step that costs.

SUMMARY OF THE INVENTION

Accordingly, it is a general object of this invention to provide a line reel for retaining, dispensing, and retrieving construction line or string from a spool that can be mounted directly onto the reel to eliminate the need to unwind the line from the spool and wind it onto the reel.

It is another general object of this invention to provide a line reel for retaining, dispensing, and retrieving construction line or string from spools having different lengths and diameters.

Another general object of this invention is to provide a line reel on which spools prewound with construction line or string can be removably mounted and replaced with other spools of prewound construction line or string.

Another general object of this invention is to provide a line reel that is rugged and inexpensive to manufacture.

Another general object of this invention is to provide a line reel that can be used to dispense construction line or string easily and safely with one hand from a prewound spool of such construction line or string.

A specific object of this invention is to provide a line reel that can be selectively connected to and removed from a prewound spool of construction line or string.

Another specific object of this invention is to provide a line reel that includes a handle that can be fastened securely to a spool of line or string in a manner that allows the spool to rotate freely in relation to the handle for dispensing line or string from the spool and for retrieving line or string onto the spool.

Another object of this invention is to provide a line reel that is usable with pre-wound spools wherein the line reel is not easily removable from the spool after it has been connected to the spool without destroying the spool.

Additional objects, advantages, and novel features of the invention shall be set forth in part in the description that follows, and in part will become apparent to those skilled in the art upon examination of the following or may be learned by the practice of the invention. The objects and the advantages may be realized and attained by means of the instrumentalities and in combinations particularly pointed out in the appended claims.

To achieve the foregoing and other objects and in accordance with the purposes of the present invention, as embodied and broadly described therein, the apparatus of the present invention is a reel that comprises a handle rotably mounted on a first shank with a first shoulder, which first shank can be inserted into one end of a spool of line or string and a second shoulder on a second shank that can be inserted into the opposite end of the spool. The first shank, spool, and second shank, when assembled together, are not freely movable in relation to each other, but they are freely rotatable in relation to the handle to facilitate dispensing the construction line or string while a person grasps the handle. In the first embodiment of the present invention, the first shank and the second shank can be slidably removed from the spool and a new spool can be mounted on the first and second shanks by exerting longitudinal forces on the spool in relation to the shanks. In the second embodiment of the present invention, the first shank and the second shank are lockable together after they are inserted into opposite ends of the spool with the first shoulder and the second shoulder, respectively, positioned adjacent opposite ends of the spool so that neither the first shank nor the second shank can be removed from the spool after they are inserted and locked together.

BRIEF DESCRIPTION OF THE DRAWINGS

The accompanying drawings, which are incorporated in and form a part of the specifications, illustrate the preferred embodiments of the present invention, and together with the descriptions serve to explain the principles of the invention.

In the Drawings.

DETAILED DESCRIPTION OF THE PREFERRED EMBODIMENTS

Figure 1:
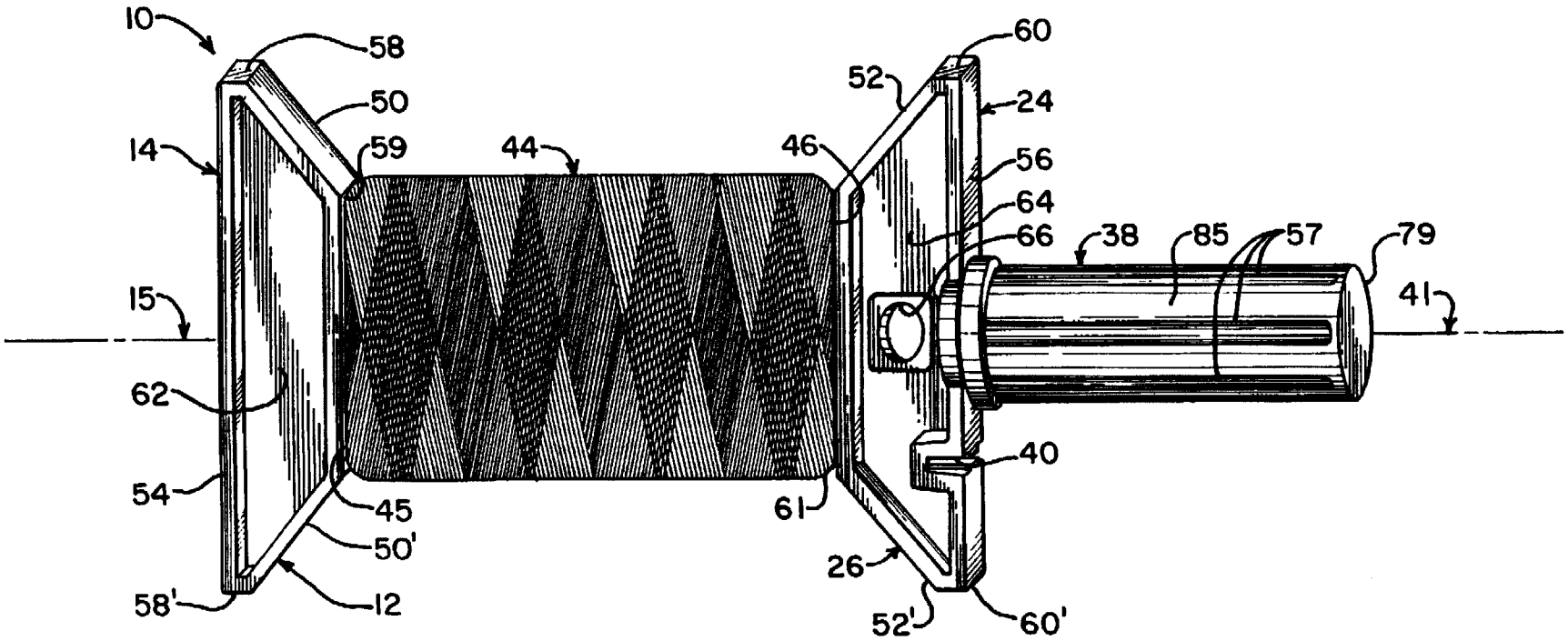
FIG. 1 is a isometric view of the present invention.
Figure 2:
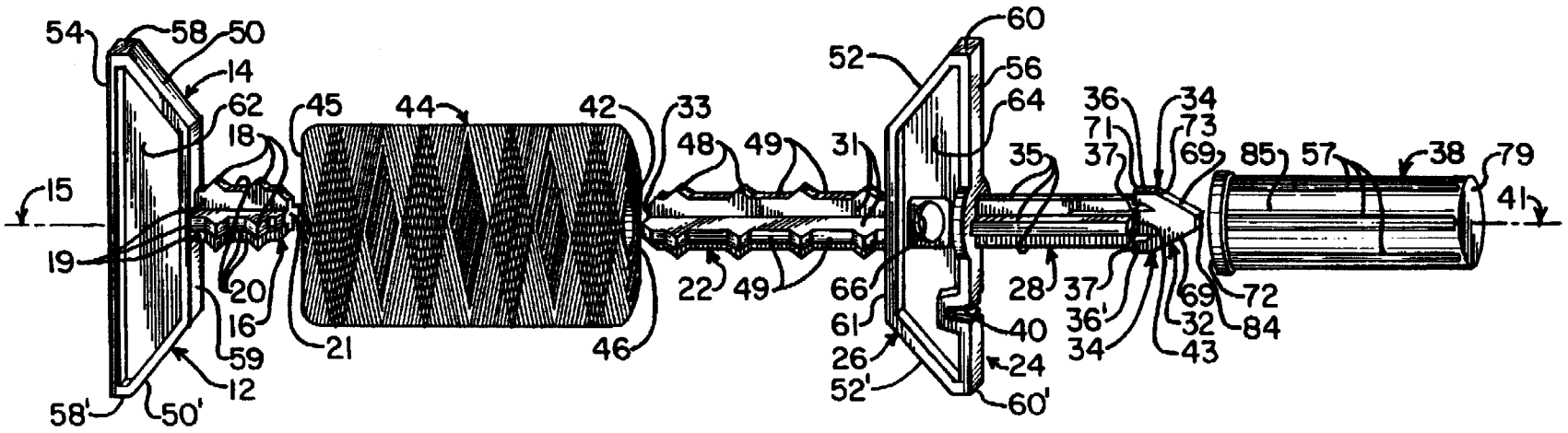
FIG. 2 is a isometric view of the first preferred embodiment of the present invention exploded to reveal the component parts.

The line reel 10 of the present invention is illustrated in FIG. 1 and includes reel cap 12, reel midsection 24, and reel handle 38 for mounting and holding a spool of construction or other cord or line 44. Reel cap 12 and reel midsection 24 are inserted into and securely engage a hollow spool 42, which is best seen in FIG. 2, from opposite ends, as will be described in more detail below. Cord spool 42 can be a conventional hollow cardboard or plastic cylinder that is commonly used for wrapping construction cord or line, thread, string, or the like around it, and the reel 10 is used for providing a convenient rotably mount and handle for the cord spool 42 and cord 44. Reel midsection 24 is inserted into reel handle 38 and engages reel handle 38 in such a way that the reel midsection 24 can rotate while reel handle 38 is held by the user, as will be described in more detail below. Operating in conjunction, reel cap 12, cord spool 42, reel midsection 24, and reel handle 38 provide the means for handling and dispensing the cord 44 that is wound around cord spool 42. When assembled, the line reel 10 has a longitudinal axis 41 that extends from reel handle 38 to reel cap 12. Reel cap 12, reel midsection 24, and cord spool 42 do not rotate in relation to each other, but they do rotate about longitudinal axis 41 in relation to reel handle 38. Reel cap 12, cord spool 42, reel midsection 24, and reel handle 38 can be constructed of wood, plastic, cardboard, paper, metal, rubber, fiberglass, or a mixture or composite of these or other suitable materials.

Reel cap 12 includes cap shoulder 14 and cap shank 16 extending axially from the shoulder 14 concentric with the longitudinal axis 41, as shown in FIG. 2. Cap shoulder 14 and cap shank 16 can be manufactured as one piece by, for example, plastic injection molding or other suitable process depending to some extent on the material used, as described above. Of course, cap shoulder 14 and cap shank 16 could also be manufactured as separate pieces and joined together by any suitable fastener or adhesive.

Cap shoulder 14 is preferably, although not necessarily, generally trapezoidal in shape with a longer base or terminal end surface 54 and, in parallel spaced-apart relation thereto, a shorter abutment surface 59, and lateral opposed side surfaces, 58, 58' and lateral inclined surfaces 50, 50', extending between the respectively opposite ends of the terminal end surface 54 and the abutment surface 59. While the cap shoulder 14 shown in FIGS. 1, 2, 8, and 10 has a generally trapezoidal side elevation shape, numerous alternative designs and dimensions of cap shoulder 14 are possible. For example, cap shoulder 14 can have a spherical shape (not shown), a flat shape (not shown), a square shape (not shown), or a cylindrical shape (not shown). Furthermore, it is preferred, but not necessary for the cap shoulder 14 to be symmetrical about a cap axis 15, which when assembled, is aligned with the longitudinal axis 41.

Cap shank 16 includes four serrated blades 19, as shown in FIG. 2, which extend from cap shoulder 14 to a distal end 21. Alternatively, cap shank 16 can have one, two, three, or more than four blades 19, or the shank 16 can be cylindrical or any other shape so long as cap core 16 can be inserted into cord spool 42. The respective serrated surfaces 20 of blades 19 have teeth 18 that extend radially outward a sufficient distance to engage the inside surface of cord spool 42 when cap shank 16 is inserted into cord spool 42 so that cap shank 16, and hence reel cap 12, are securely engaging cord spool 42. Cap shank 16 can be removed from cord spool 42 by pulling on cap brace 14.

When cap shank 16 is inserted into cord spool 42, the longitudinal axis 15 of cap shank 16 is aligned with the longitudinal axis of the cord spool 42, which runs longitudinally through the center of cord spool 42. The dimensions and shapes of blades 19, teeth 18, and surfaces 20 can vary, so long as cap shank 16 and reel cap 12 will be securely engaged with cord spool 42, and the cap axis 15 is aligned with the cord spool longitudinal axis, when cap shank 16 is inserted into the cord spool 42. Likewise, the number of blades 19, teeth 18, and surfaces 20 can vary, so long as cap shank 16 and reel cap 12 will be securely fastened to cord spool 42, and the cap axis 15 is aligned with the cord spool longitudinal axis, when cap shank 16 is inserted into the cord spool 42. The length and width of cap shank 16 and cap blades 19 can be designed to fit a particular cord spool 42 length and diameter. Therefore, a different reel cap 12, having a specific cap shank 16 length and width that is optimal for a specific cord spool length and diameter, may not be optimal for a different cord spool having a different dimension or different dimensions. When cap shank 16 is inserted into cord spool 42, cord spool end 45 will be positioned preferably to abut the front surface 59 of cap shoulder 14, as shown in FIG. 1.

Figure 3:
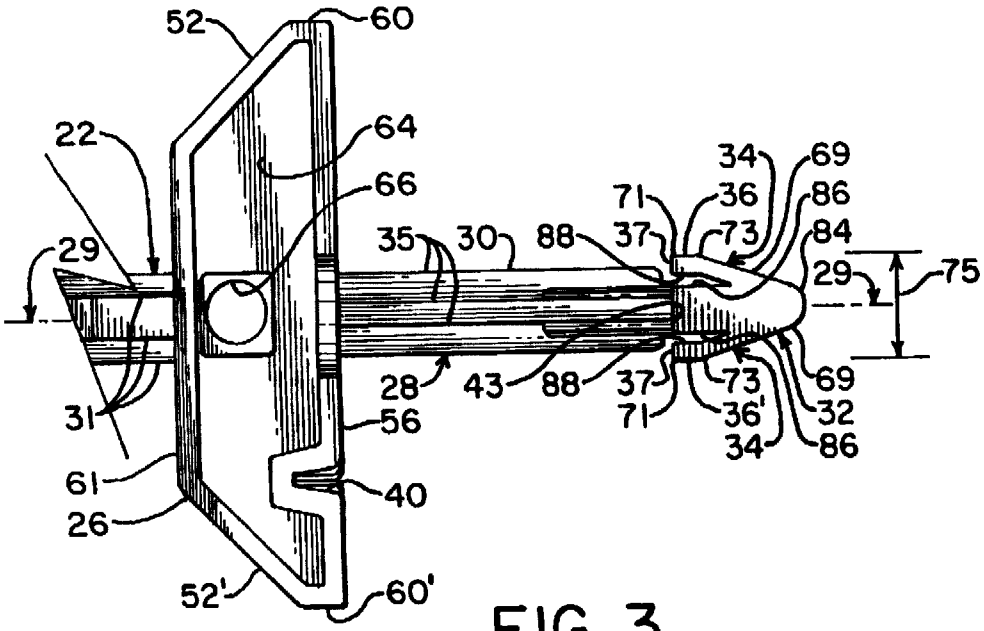
FIG. 3 is a side elevation view of the reel midsection with the reel handle removed to reveal the structure of the real handle mounting and retaining structure.

Reel midsection 24 includes midsection shank 22, midsection shoulder 26, and handle spindle 28, as shown in FIGS. 2 and 3. Midsection shank 22 extends axially from shoulder 26 and is aligned so that the longitudinal axis of midsection shank 22 is aligned with the longitudinal axis of the rotation 29 of reel midsection 29. Midsection shank 22 is preferably symmetrical about midsection axis 29.

Midsection shank 22 includes four serrated blades 31, as shown in FIG. 2, which are similar to the serrated blades 19 of the cap shank 16 described above. The blades 31 extend from midsection shoulder 26 to a distal end 33. Distal end 33 can be flat, as shown in FIG. 2, or rounded (not shown), or it can have another configuration. Alternatively, midsection shank 22 can have one, two, three, or more than four blades 31, or it can be cylindrical or any other suitable shape so long as midsection shank 22 can be inserted into cord spool 42. Similar to the core blades 19 of cap shank 16 discussed above, blades 31 of midsection shank 22 can be serrated to include teeth 48 extending radially outward from surfaces 49 to engage the inside surface of cord spool 42 when midsection shank 22 is inserted into cord spool 42 so that midsection shank 22, hence reel midsection 24, are frictionally engaged with cord spool 42. When midsection shank 22 is inserted into cord spool 42, midsection core axis 29 is aligned with the cord spool axis running longitudinally through the center of cord spool 42. The dimensions of spool supports 48 and side surfaces 49 can vary, so long as midsection core 22 and reel midsection 24 will be securely engaged with cord spool 42 and the midsection shank axis 29 is aligned with the cord spool axis when midsection shank 22 is inserted into the cord spool 42 as was described above for the cap shank 19. Likewise, the number of teeth 48 and surfaces 49 can vary, or the teeth 48 can be eliminated, so long as the dimensions are such that midsection shank 22 and reel midsection 24 will be securely engaged with cord spool 42 and the midsection axis 29 is aligned with the cord spool axis when midsection shank 22 is inserted into the cord spool 42. The length and width of midsection shank 22 and midsection blades 31 can be designed to fit a particular cord spool 42 length and diameter. Therefore, a different reel midsection 24, having a specific shank 22 length and width that is optimal for a specific cord spool length and diameter, may not be optimal for a different cord spool having a different dimension or different dimensions.

Midsection shoulder 26 includes abutment surface 61, opposite side surfaces 60, 60', inclined guide surfaces 52, 52', end surface 56, and opposing lateral surfaces 64, 64' (64' is not shown as it is opposite surface 64 in the drawings). Note that numerous alternative designs and dimensions of midsection shoulder 26 are possible. For example, midsection shoulder 26 can have a spherical shape (not shown), a square shape (not shown), or a cylindrical shape (not shown). Furthermore, it is preferred but not necessary that midsection shoulder 26 is symmetrical about the midsection axis 29. When midsection shank 22 is inserted into cord spool 42, cord spool end 46 will be positioned approximately against or abutting midsection shoulder abutment surface 61, as shown in FIG. 1. Midsection shoulder 26 also includes a cord notch 40 to releasably secure a loose end of the cord. The design and use of a cord notch is known to people having ordinary skill in the art. In addition, midsection shoulder 26 can include a hole 66 to enable the user to hang line reel 10 on, for example, a hook or a nail.

Figure 4:
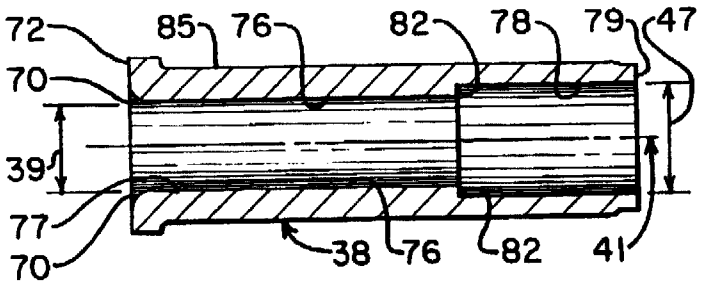
FIG. 4 is a cross-sectional view of the reel handle without the reel midsection inserted into the reel handle.
Figure 5:
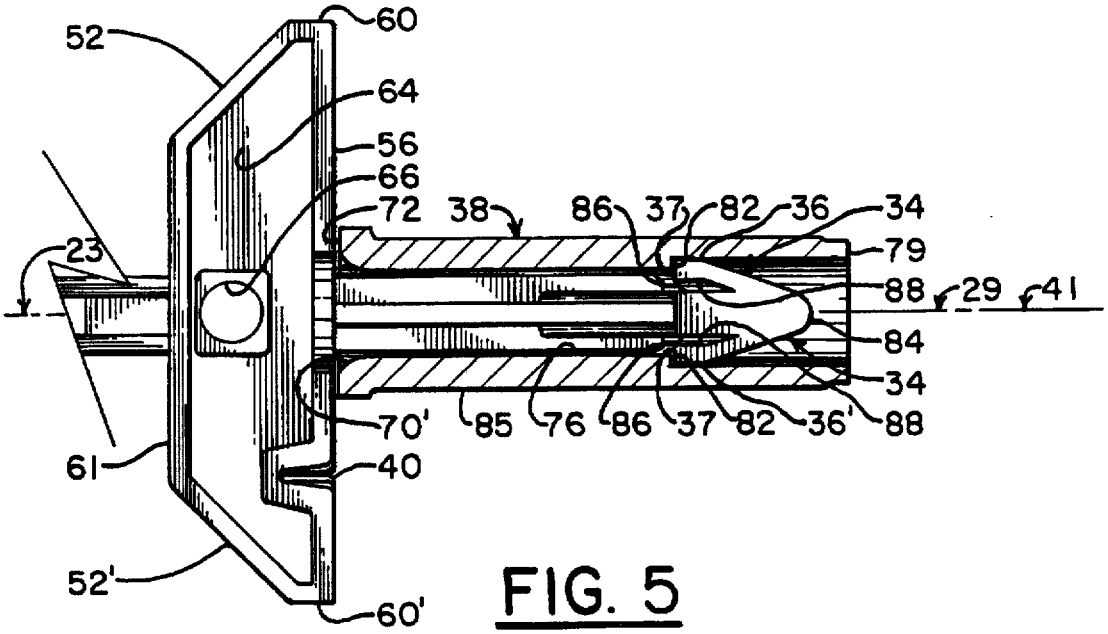
FIG. 5 is a cross-sectional view of the reel handle similar to FIG. 4, but with handle mounting structure protruding from the reel midsection completely inserted into the reel handle.

Spindle 28 is used to rotatably support handle 38, as mentioned above, and has a retainer 32 at its distal end for engaging and retaining the handle 38, as shown in FIGS. 2, 3, and 5. Spindle 28 and retainer 32 can be manufactured as one piece by, for example, injection molding or other suitable process. Spindle 28 can include four blades 35, as shown in FIGS. 2, 3, and 5 or it can be cylindrical (not shown) or any other suitable shape. Blades 35 extend from end surface 56 of shoulder 24 to an end surface 43 of spindle 28, which can be flat, as shown in FIGS. 2 and 3, or it can have another configuration, so long as the spindle 28 is smaller than the inside diameter 39 of bore 77 of reel handle 38, which is shown in FIG. 4. Alternatively, spindle 28 can have one, two, three, or more than four blades 35 or be any other shape, so long as it can be inserted into reel handle 38.

Figure 6:
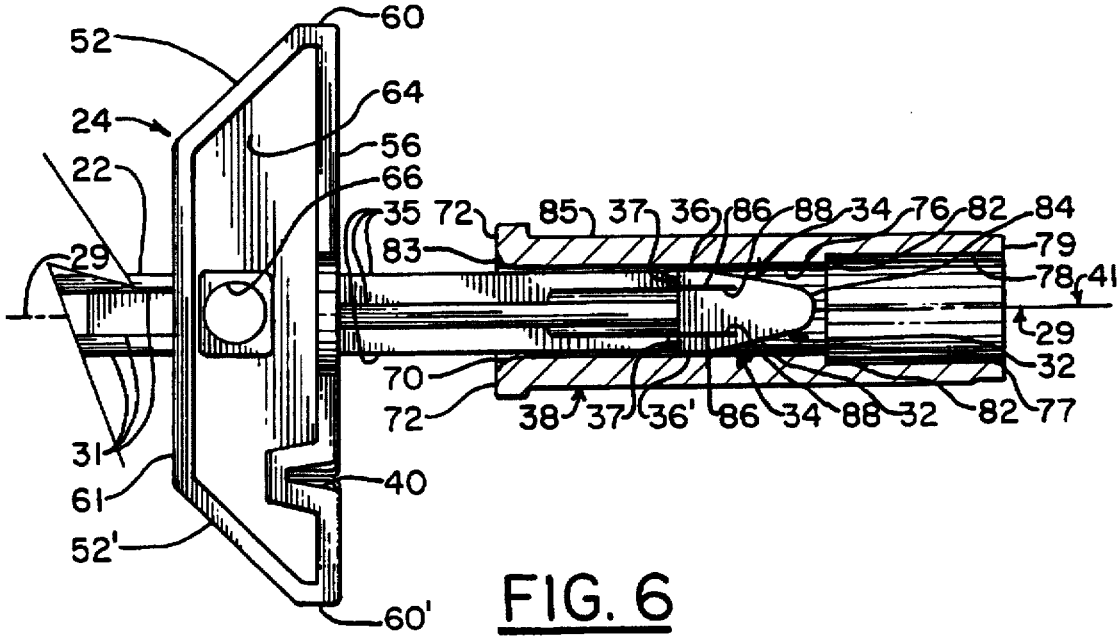
FIG. 6 is a cross-sectional view of the reel handle and mounting structure similar to FIG. 5, but with the handle mounting structure of the reel midsection partially inserted into the reel handle.
Figure 7:
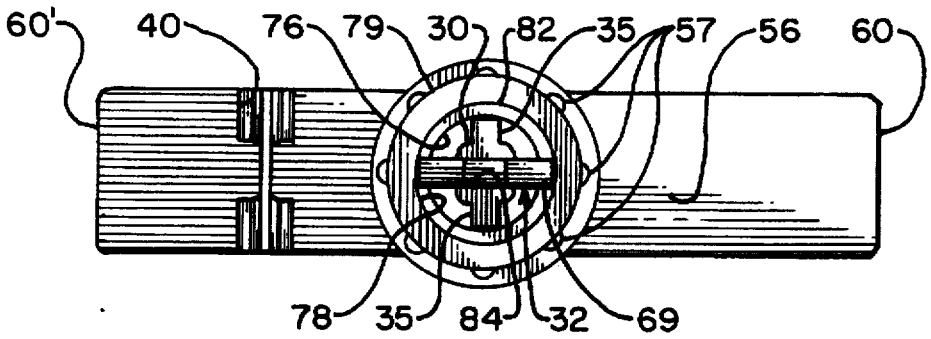
FIG. 7 is an end elevation view of the reel mounting structure and the reel handle with the reel midsection completely inserted into the reel handle.
Figure 9:
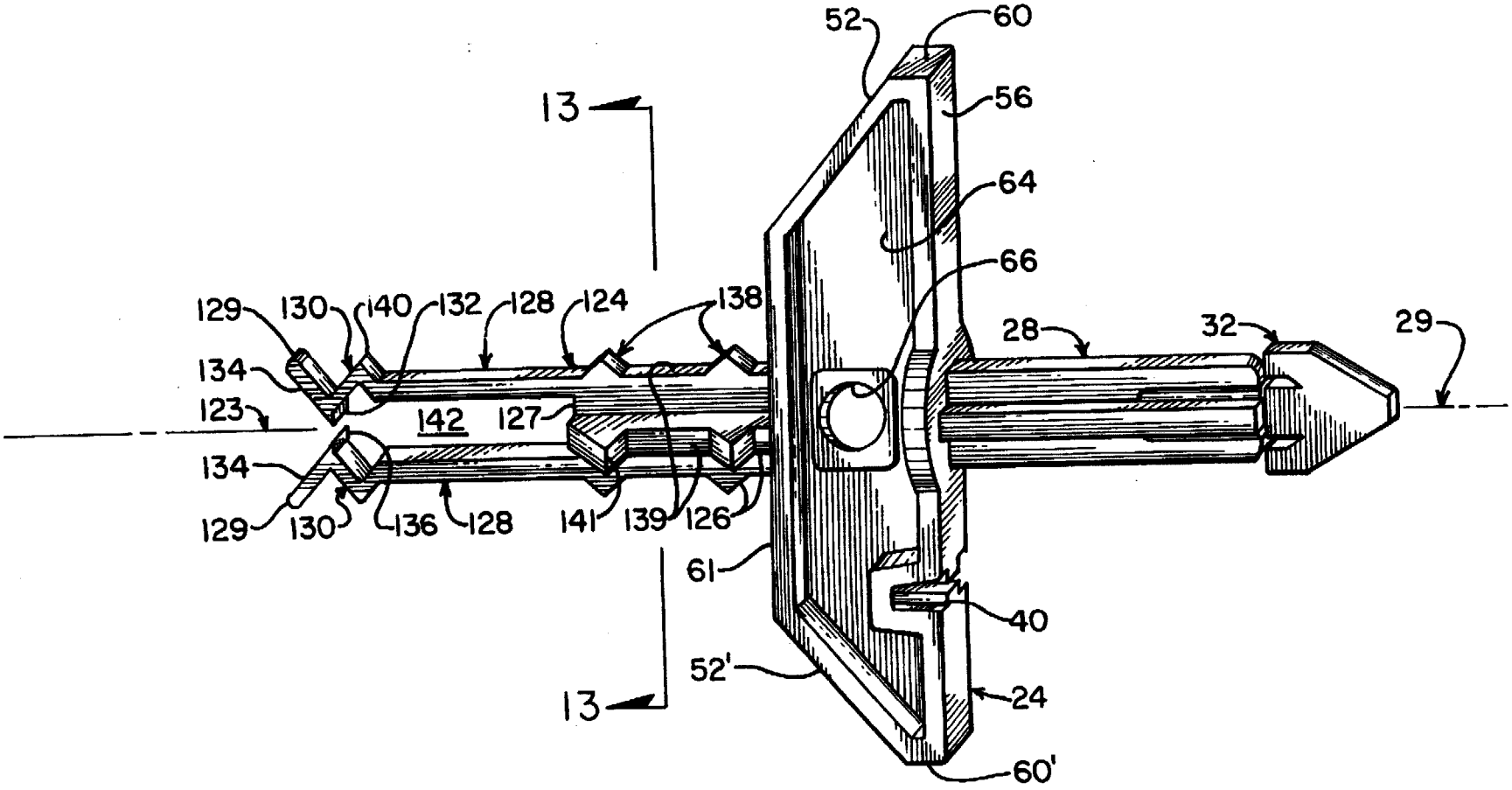
FIG. 9 is a diagrammatic view of the reel midsection of the second embodiment of the present invention.

Retainer 32 has two flange extensions 34 that are evenly spaced and symmetrical about axis 29. Each flange extension 34 extends radially outwardly and rearwardly toward spindle 28. Each flange extension 34 has an inclined edge 69 extending from a nose 84 to an outer edge 73 so that retainer 32 is generally tapered in a direction to an end 37. Nose 84 can be flat, as shown in FIGS. 2 and 9, or rounded, as shown in FIG. 3, 5, and 7. As shown in FIG. 3, surfaces 36, 36' of flange extensions 34 extend from edge 73 to edge 71 and approximately parallel to axis 29. The distance 75 between surface 36 and surface 36' is greater than the inner diameter 39 of reel handle 38 and approximately equal to, but not greater than or exactly equal to, the inner diameter 47 of bore 77 of reel handle 38, which is shown in FIG. 4. The tapered design of retainer 32 and the use of nose 84 and surface 36 enable midsection connector 28 to be inserted into reel handle 38, as shown in FIGS. 5 and 6 and as will be discussed in more detail below.

Referring now to FIG. 4, reel handle 38 has a generally cylindrical shape with a bore 77 extending longitudinally along axis 41 through the entire length of reel handle 38. The peripheral surface 85 of reel handle 38 need not be symmetrical about reel handle axis 41, any suitable shape or handgrip can be used. Reel handle 38 can include optional semicircle shaped grips 57, as shown in FIGS. 1, 2, and 7, positioned longitudinally along reel handle 38 on surface 85 to facilitate handling of the line reel 10.

As shown in FIG. 4, bore 77 of reel handle 38 is symmetrical about reel handle axis 41. Proximal end surface 72 is approximately perpendicular to any plane containing longitudinal axis 41 so that surface 72 is positioned adjacent and juxtaposed to end surface 56 of shoulder 24 when spindle 28 is inserted into bore 77 of reel handle 38, as shown in FIG. 5. A concave contoured surface 70 extends from surface 72 to inner handle surface 76 to make it easier for nose 84, midsection flange 32, and midsection elongation 30 to be inserted into bore 77 of reel handle 38, as will be discussed in more detail below.

As shown in FIG. 4, inner diameter 39 of bore 77 is smaller than inner diameter 47 of bore 77 so that inner shoulder 82 is created in reel handle 38. Inner handle surface 76 extends from concave surface 70 to inner shoulder 82. Inner handle surface 78 extends from inner shoulder 82 to the distal end 79 of handle 38. Inner surface 76, inner surface 78, and inner edge 82 are preferably symmetrical about reel handle axis 41. As discussed above, inner diameter 39 is approximately the same length as the longest dimension of the cross-section of spindle 28 so that spindle 28 fits comfortably, but not tightly, within reel handle 38, as shown in FIG. 5. In addition, as discussed above, inner diameter 47 is greater than or equal to the distance 75 between surface 36 and surface 36' of retainer 32.

To insert spindle 28 into reel handle 38, nose 84 of retainer 32 is first inserted into bore 77 of reel handle 38. The insertion is facilitated by the tapered design and elastic resilience of the tapered flange extensions 34 of retainer 32 and the contoured surface 70 of reel handle 38. As retainer 32 is inserted further into bore 77 of reel handle 38, flange extensions 34 are compressed radially inward and toward each other by inner surface 76 of reel handle 38, as shown in FIG. 6. Surfaces 88 of flange extensions 34 will then be adjacent surface 86. When retainer 32 is inserted into bore 77 of reel handle 38 far enough so that proximal surface 72 of reel handle 38 is adjacent end surface 56 of shoulder 24, surface 37 of flange extension 34 will be extended past the shoulder 82 in reel handle 38, as shown in FIG. 5. When spindle 28 is completely inserted into bore 77 of reel handle 38, midsection connector axis 29 will be aligned with reel handle axis 41. In addition, surface 37 of flange extension 34 will be adjacent shoulder 82, and flange extensions 34 will no longer be compressed by inside surface 76. Therefore, the resilience of the flange extensions 34 will cause them to return radially outward to their normal configuration, as shown in FIGS. 5 and 7, and surfaces 36, 36' of flange 32 will be adjacent or approximately adjacent inner surface 78 of reel handle 38. In addition, surfaces 88 of flange extensions 34 will no longer be adjacent flange surface 86. Reel handle 38, therefore, becomes effectively locked into this assembled position and cannot be removed from spindle 28 due to surface 37 at the end of each flange extension 34 abutting the shoulder 82 in handle 38. While spindle 28 fits comfortably enough within reel handle 38 so that longitudinal axis 29 of the midsection shoulder 24 is aligned with reel handle axis 41, spindle 28, hence, shoulder 24, can still rotate freely within handle 38 about axis 29.

For operation of the first embodiment of line reel 10, a hollow cylindrical cord spool 42 is wound with suing, construction line, thread, or other suitable material. Cap shank 16 of reel cap 12 is inserted into one end of cord spool 42 while midsection shank 22 of reel midsection 24 is inserted into the other end of cord spool 42. Teeth 18 of cap shank 16 engage the inside surface (not shown) of cord spool 42, when cap shank 16 is inserted into cord spool 42, so that cap shank 16, hence reel cap 12, securely engages cord spool 42. Likewise, teeth 48 of midsection shank 22 engage the inside surface (not shown) of cord spool 42 when midsection shank 22 is inserted into cord spool 42 so that midsection shank 22, hence reel midsection 24, are securely engaged with cord spool 42. The assembled line reel 10 is shown in FIG. 1.

During operation, reel cap 12, reel midsection 24, and cord spool 42 rotate about reel axis 29 and handle axis 41. The string, construction line, thread, or other suitable material wound around cord spool 42 can, therefore, be conveniently unwound from cord spool 42 or rewound around cord spool 42. The inclined surfaces 50, 50' of cap shoulder 14 and 52, 52' of midsection shoulder 24 guide the cord off and onto the cord spool 42 and help retain the cord on the reel 10 if the cord is not rewound exactly back onto the spool 42. Minimum attention from the user is required to dispense the wound material. Line reel 10 works best if line reel 10 is oriented perpendicular to the direction in which the construction line is being dispensed, although inclined surfaces 50, 50' of reel cap 12 and inclined surfaces 52, 52' of reel midsection 24 facilitate deployment of the construction line in any direction since inclined surfaces 50, 50' of reel cap 12 and inclined surfaces 52, 52' of reel midsection 24 prevent the construction line from snagging or catching on a sharp or pointed edge as the construction line is being dispensed.

Should the user desire to replace the cord spool 42 and the wound material, for example, if the cord spool 42 is empty or if the material wound around the cord spool 42 becomes tangled, knotted, soiled or too short, reel cap 12 and reel midsection 24 can be removed from cord spool 42 by pulling them out of cord spool 42. Reel cap 12 and reel midsection 24 can then be inserted into a new cord spool.

Figure 10:
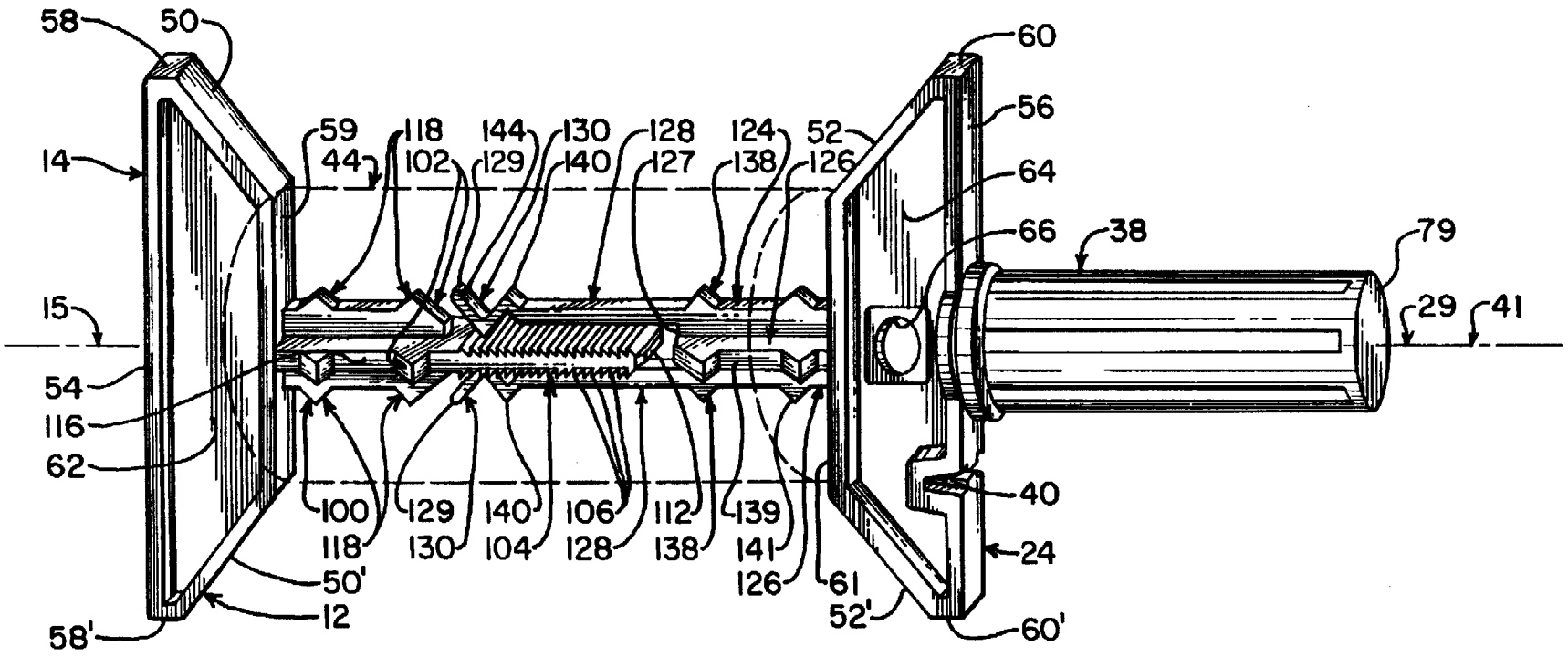
FIG. 10 is a diagrammatic view of the reel cap and the reel midsection of the second embodiment of the present invention assembled with the reel cap engaging the reel midsection and the line spool shown only in phantom lines so as not to obscure the engaging structure.

A second embodiment of the present invention is shown in FIGS. 8, 9, 10, 11, 12, and 13. In the second embodiment, cap shoulder 14, midsection shoulder 26, spindle 28, and reel handle 38 are structured, assembled, and function substantially as described above. The difference between the first embodiment and the second embodiment is provided by cap shank 100 and midsection shank 124, as shown in FIGS. 8, 9, 10, 11, 12, and 13. Cap shank 100 and midsection shank 124 can be fastened securely together when they are inserted into cord spool 42, as shown in FIG. 10, and as will be described in more detail below.

Figure 8:
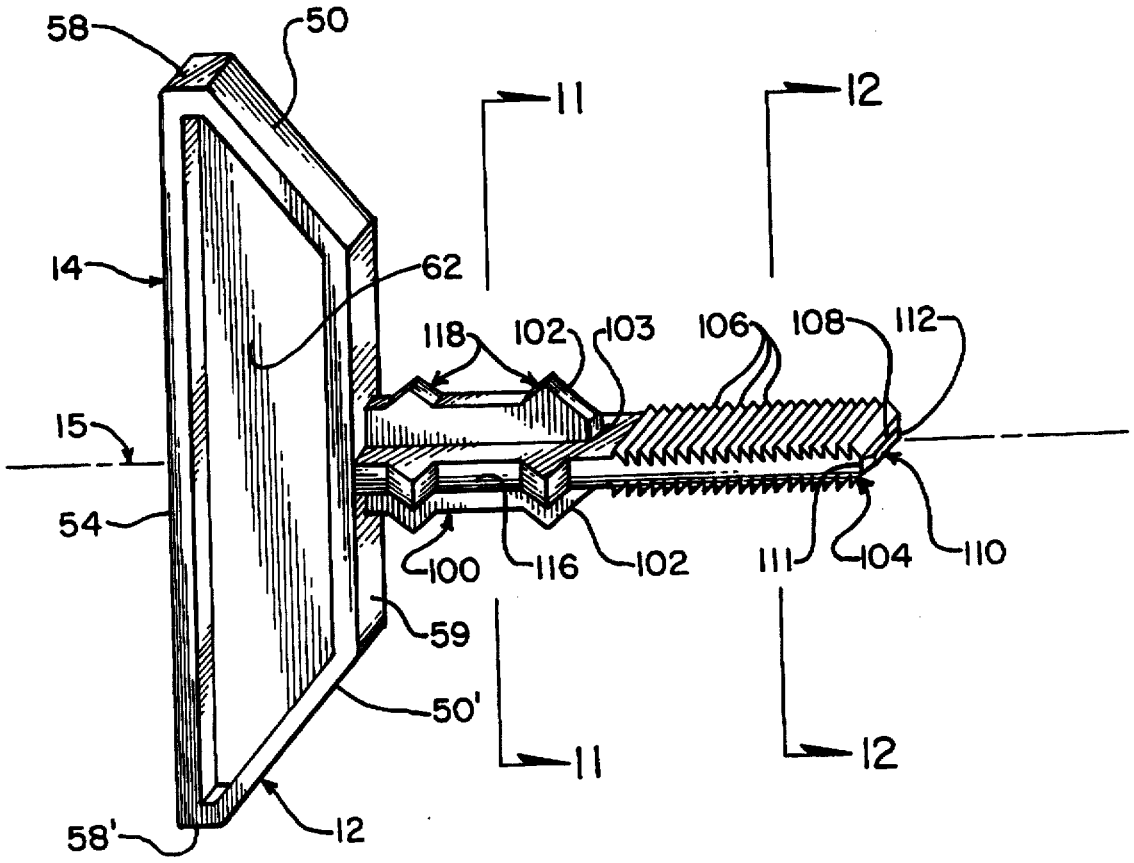
FIG. 8 is a diagrammatic view of the reel cap of the second embodiment of the present invention.

As shown in FIGS. 8 and 10, cap shank 100 includes serrated blades 102 with teeth 118 and surfaces 116, which function in a manner similar to the blades 19, teeth 18, and surfaces 20 described above for the first embodiment of the present invention. Likewise, midsection shank 124 includes serrated blades 126 with teeth 138 and surfaces 139, which function in a manner similar to midsection blades 31, teeth 48, and surfaces 49 described above for the first embodiment of the present invention.

Figure 11:
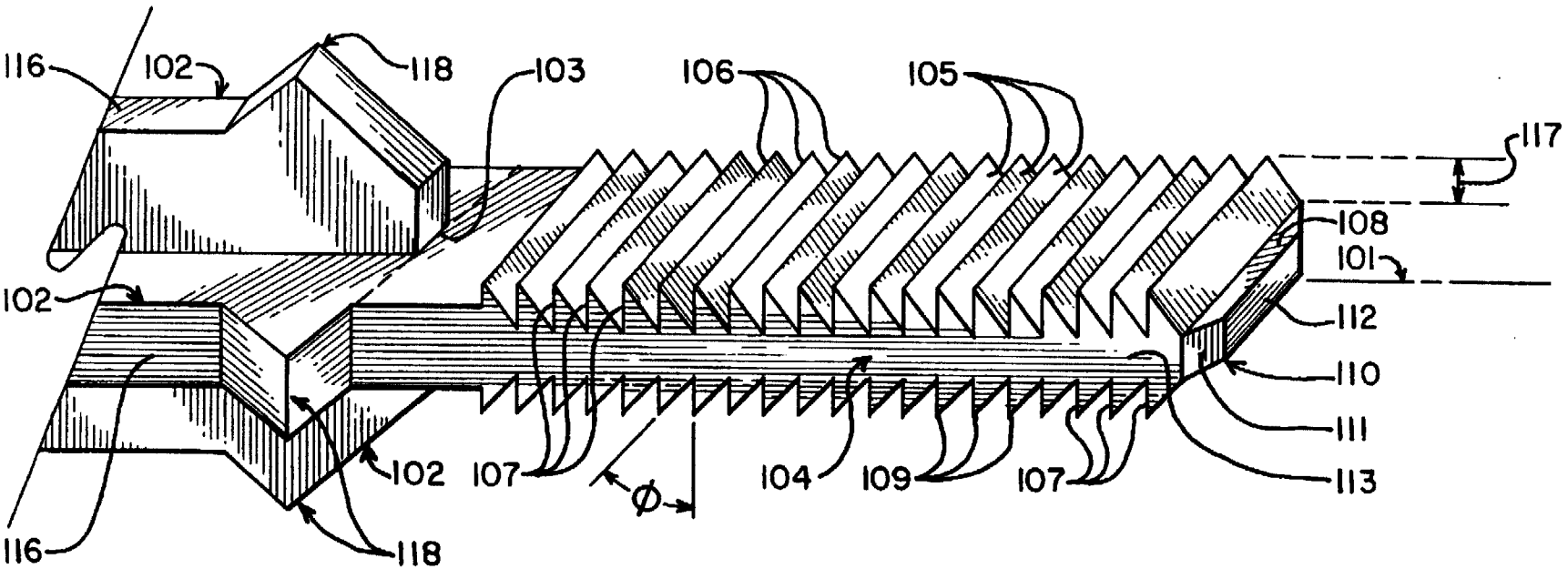
FIG. 11 is an enlarged view of the male end of the engaging structure.
Figure 12:
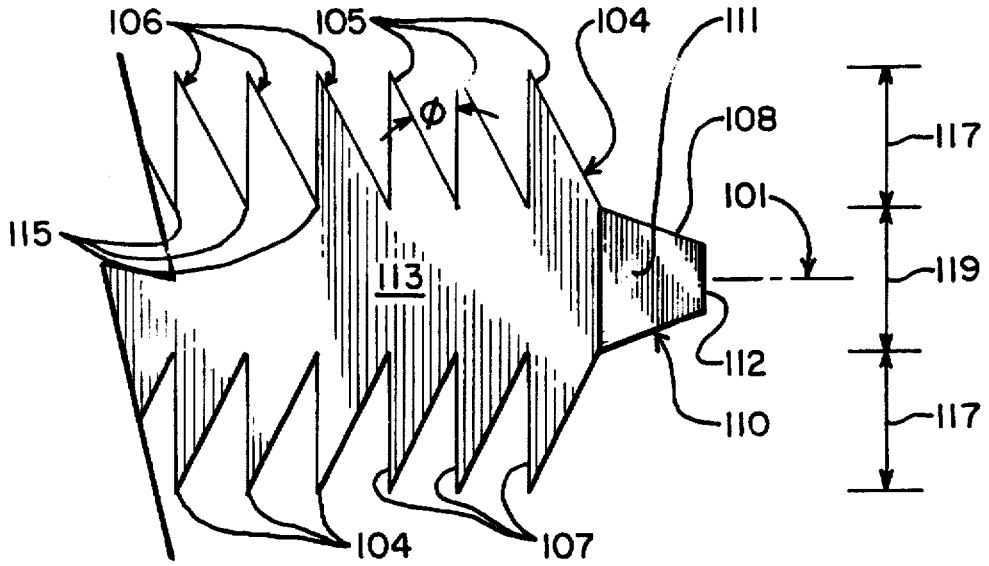
FIG. 12 is an enlarged side elevation view of the male portion of the engagement structure of FIG. 11.

In contrast to the first embodiment of the present invention, cap shank 100 includes wedge 104, as shown in FIGS. 8, 10, 11, and 12. Wedge 104 extends from the end 103 of blades 102 to a distal end 112 and terminates in a nub 110. The nub 110 has a generally rectangular shape with tapered side surfaces 108 and 111, as best seen in FIG. 12.

As shown in FIGS. 8, 10, 11, and 12, cap core wedge 104 includes symmetric wedge extensions 106. Wedge extensions 106 further include inclined wedge surfaces 105 and transverse wedge surfaces 107. Wedge extensions 106 and, therefore, surfaces 105 and 107, extend outwardly from the central shaft 113 of cap core wedge 104 at positions 105. Inclined surfaces 105 and transverse surfaces 107 intersect to form edges 109. Surfaces 105 also extend from grooves 115 rearwardly away from central shaft 113 and wedge end surface 112. An angle $\phi$ is created between side surface 105 and side surface 107, as shown in FIG. 11. Transverse surfaces 107 extend from groove 115 in a generally perpendicular direction away from central shaft 113.

Figure 13:
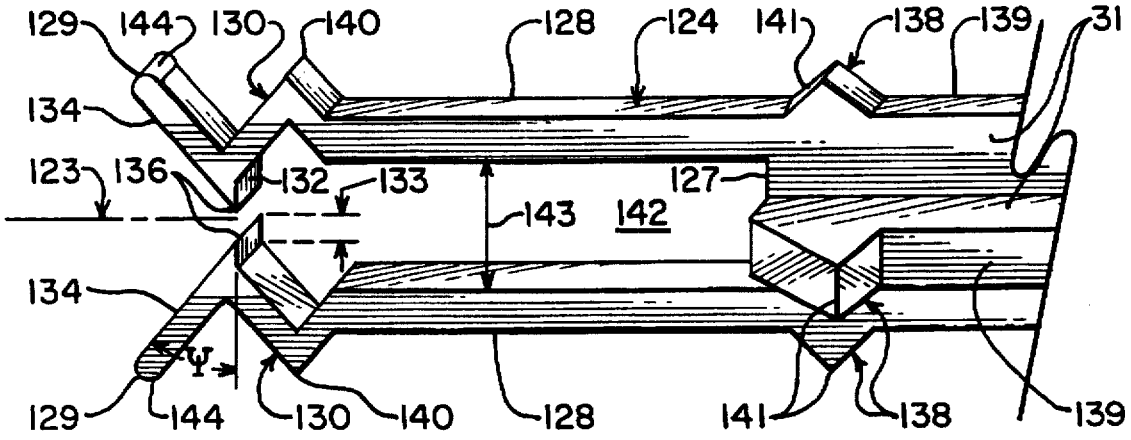
FIG. 13 is an enlarged view of the female end of the engaging structure of FIG. 12.

Also in contrast to the first embodiment 10 of the present invention, midsection shank 124 of the second embodiment includes two parallel prongs 128, as shown in FIGS. 9, 10, and 13. Prongs 128 extend from the end 127 to blades 31 to prong ends 129. A slot 142, having a generally rectangular configuration, is created between the two prongs 128. The slot height 143 is approximately equal to, but not less than, the height 119 of wedge 104. Each core prong 128 includes a z-shaped prong tip 130 designed to securely engage cap wedge 104 when cap shank 100 and midsection shank 124 are inserted into cord spool 42, as shown in FIGS. 9 and 10 and as will be described in more detail below.

Prong tip 130 includes tip surface 132 and tip surface 134 which extend into slot 142 from prong tip 130 and meet at tip edge 136. Tip surface 132 and tip surface 134 form an angle $\psi$ at tip edge 136, as illustrated in FIG. 12. The angle $\psi$ is approximately equal to, and preferably not greater than, the angle $\phi$ between wedge surface 105 and wedge surface 107 described above. Prong surface 134 extends outwardly from prong edge 136 to prong end 129, as shown in FIGS. 9 and 13, to facilitate engagement with core wedge 104, as will be described in more detail below. Tip surface 132 has a height 133 that is approximately equal to the height 117 of wedge extensions 106.

Tip 140 and end 144 can function as teeth to engage the cord spool 42 (not shown in FIG. 13) in the same manner as teeth 138 described above. Furthermore, tip 140 and end 144 are positioned approximately the same distance away from the midsection axis 123 as spool support edge 141 is positioned away from midsection axis 123 and serve a similar purpose as teeth 138 described above.

While the second embodiment of the present invention has discussed and shown the prongs 128 extending from midsection shank 124 and cap core wedge 104 extending from cap shank 100, obviously the design could be reversed such that the prongs 128 extend from cap shank 100 and the cap wedge 104 extends from midsection shank 124, without changing the spirit or scope of the invention.

For operation of the second embodiment of line reel 10, a hollow cylindrical cord spool 42 is wound with string, construction line, thread, or other suitable material. Cap shank 100 of reel cap 12 is inserted into one end of cord spool 42 while midsection shank 124 of reel midsection 24 is inserted into the other end of cord spool 42. Teeth 118 of cap shank 100 engage the inside surface (not shown) of cord spool 42 when cap shank 100 is inserted into cord spool 42 so that cap shank 100 and reel cap 12 are securely engaging cord spool 42. Likewise, teeth 138 of midsection shank 124 engage the inside surface (not shown) of cord spool 42 when midsection shank 124 is inserted into cord spool 42 so that midsection shank 124, hence reel midsection 24, are securely engaging cord spool 42. Midsection connector 28 is inserted into reel handle 38, as described above.

When both cap shank 100 and midsection shank 124 are inserted into cord spool 42 they will securely fasten together and cap axis 101 will be aligned with midsection axis 123, as shown in FIG. 10. At the start of the fastening process when cap shank 100 and midsection shank 124 are being inserted into cord spool 42, wedge end extension 110 will engage tip surface 134 of both prong tips 130 as wedge extension 110 and cap wedge 104 are positioned into slot 142. The sloped side surfaces 111 and 108 of wedge end extension 110 acting against tip surface 134 of prong tips 130 facilitate the separation of prong tips 130. Since the engagement of cap wedge 104 and prongs 128 is occurring within the hollow center (not shown) of cord spool 42, cap wedge 104 and prongs 128 cannot be laterally displaced so as to cause a failure of cap wedge 104 and prongs 128 to securely fasten. As wedge end extension 110 and thus, cap wedge 104, are positioned farther into slot 142, tip surface 134 begins to engage wedge surface 105. The sloped and angled wedge surface 105 and tip surface 134 enable cap wedge 104 to be easily positioned inside slot 142. The inside surface of cord spool 42 acts against tip surface 140 and tip surface 144 to force tip edge 136 into the channel created by wedge surface 105 and wedge surface 107. Wedge surface 107 acting against tip surface 132 prevents the cap wedge 104 and the prongs from becoming disengaged, as shown in FIGS. 10 and 11. Therefore, cap shank 100 and midsection shank 124 are latched together and not removable from cord spool 42 after they are inserted into cord spool 42 and cap wedge 104 becomes securely fastened with prongs 128. After cap 100 is completely inserted into cord spool 42, cord spool end 45 will be positioned approximately against cap shoulder front surface 59, as shown in FIG. 1. Likewise, when midsection shank 124 is completely inserted into cord spool 42, cord spool end 46 will be positioned approximately against midsection shoulder front surface 61, as shown in FIG. 1.

The foregoing description is considered as illustrative only of the principles of the invention. Furthermore, since numerous modifications and changes will readily occur to those skilled in the art, it is not desired to limit the invention to the exact construction and process shown as described above. Accordingly, all suitable modifications and equivalents may be resorted to falling within the scope of the invention as defined by the claims which follow.

The embodiments of the invention in which an exclusive property or privilege is claimed are defined as follows:

1. A line reel for mounting a construction line spool that has a hollow cylindrical shape with a first end and a second end and an inside surface with an inside diameter, said line reel comprising:

a midsection with a midsection shoulder that is wider than the inside diameter of the spool, an elongated midsection shank extending axially from the midsection shoulder into the first end of the spool and having a transverse structural configuration that is large enough to engage the inside surface of the spool, and a rotatable handle extending axially from the midsection shoulder in a direction opposite the midsection shank; and a cap with a cap shoulder that is wider than the inside diameter of the spool, an elongated cap shank extending axially from the cap shoulder into the second end of the spool and having a transverse structural configuration that is large enough to engage the inside surface of the spool.

2. The line reel of claim 1, including construction line wound on the spool to make a construction line and spool combination that has an outside diameter, said midsection shoulder and said cap shoulder both being wider than said outside diameter.

3. The line reel of claim 1, wherein said midsection shank has a serrated edge.

4. The line reel of claim 1, wherein said cap shank has a serrated edge.

5. The line reel of claim 1, wherein said midsection shank has a distal end with a first latch mechanism and said cap shank has a distal end with a second latch mechanism that latches to said first latch mechanism when the midsection shank and the cap shank are positioned in said spool.

6. The line reel of claim 5, wherein the midsection shank and the cap shank have a combined length that positions the midsection shoulder in abutting relation to the first end of the spool and positions the cap shoulder in abutting relation to the second end of the spool when the first latch mechanism latches to the second latch mechanism.

7. A line reel for dispensing construction line wound around a hollow spool, comprising:

a handle having a hollow cylindrical interior and a longitudinal axis extending through the center of said handle;

a cap including an extended shank, wherein said extended shank is removably inserted into a first end of the spool and wherein said extended shank includes attaching means for removably attaching said extended shank to the inside surface of the hollow interior of the spool;

a midsection including a brace, a first elongated shank, and a second elongated shank, wherein said first elongated shank and said second elongated shank extend outward from said brace in opposite directions and said first elongated shank and second elongated shank lie along the same longitudinal axis, further wherein said first elongated shank is removably inserted into the end of the spool opposite said extended shank, and said first elongated shank includes securing means for removably securing said first elongated shank to the inside surface of the hollow interior of the spool, and wherein said second elongated shank is inserted into said hollow interior of said handle;

connecting means for connecting said second elongated shank to said handle such that said elongated shank can rotate about the longitudinal axis of said handle.

8. The line reel of claim 7, wherein said cap includes sloped surfaces extending outwardly and away from the spool.

9. The line reel of claim 7, wherein said brace includes sloped surfaces extending outwardly and away from the spool.

10. The line reel of claim 7, wherein said connecting means includes a flange attached to the end of said second elongated shank opposite said brace, said interior of said handle includes a first portion having a first diameter and a second portion having a second diameter so that said second diameter is larger than said first diameter, wherein a lip is formed in said interior of said handle at the intersection of said first portion and said second portion and said flange engages said lip such that said second elongated shank is not removable from said handle after said flange and said elongated shank have been inserted into said interior of said handle such that said flange has passed through the entire length of said first portion of said interior of said handle and is positioned in said second portion of said interior of said handle.

11. The line reel of claim 10, wherein said flange includes a flange extension extending outward from the forward end of said flange and rearward from the forward end of said flange toward said brace.

12. The line reel of claim 11, wherein said flange extension is compressed by the action of the interior surface of said first portion of said handle engaging said flange extension inward toward the longitudinal axis of said second elongated shank when said second elongated shank is inserted into said first portion of said handle and said flange extension is positioned in said first portion of said handle, further wherein said flange extension is not compressed when said flange extension is positioned in said second portion of said handle.

13. A line reel for dispensing construction line wound around a hollow spool, comprising:

a handle having a hollow cylindrical interior and a longitudinal axis extending through the center of said handle;

a cap including an extended shank, wherein said extended shank is inserted into a first end of the spool and wherein said extended shank has a longitudinal axis and wherein said extended shank includes attaching means for attaching said extended shank to the inside surface of the hollow interior of the spool;

a midsection including a brace, a first elongated shank, and a second elongated shank, wherein said first elongated shank and said second elongated shank extend outward from said brace in opposite directions and said first elongated shank and second elongated shank lie along the same longitudinal axis, further wherein said first elongated shank is inserted into the end of the spool opposite said extended shank, and said first elongated shank includes securing means for securing said first elongated shank to the inside surface of the spool, said second elongated shank is inserted into said hollow interior of said handle;

connecting means for connecting said second elongated shank to said handle such that said elongated shank can rotate about the longitudinal axis of said handle;

fastening means for securely fastening said extended shank and said first elongated shank when said extended shank and said first elongated shank are inserted into the opposite ends of the hollow spool.

14. The line reel of claim 13, wherein said fastening means includes two prongs extending longitudinally outward from the end of said first elongated shank inserted into the hollow spool, said prongs forming a slot between them, further wherein said extended shank includes a wedge extending longitudinally outward from the end of said extended shank inserted into the hollow spool, and wherein said wedge is inserted into said slot when both said extended shank and said first elongated shank are inserted into opposite ends of the hollow spool.

15. The line reel of claim 14, further including a prong restraint extending from one of said prongs into said slot, wherein said wedge includes a wedge restraint extending outward from the surface of said wedge, and wherein said prong restraint securely engages said wedge restraint when said wedge is inserted into said slot.

16. The line reel of claim 15, wherein said prong restraint includes two prong restraint surfaces extending from said prong into said slot and forming an acute angle $\psi$ between them at the intersection of said prong restraint surfaces, said wedge restraint includes two wedge restraint surfaces extending outward from said wedge and forming an acute angle $\phi$ between them on the outer surface of said wedge at the intersection of said wedge restraint surfaces, wherein said angle $\phi$ is greater than or equal to said angle $\psi$.

17. The line reel of claim 16, wherein one of said prong restraint surfaces is perpendicular to every geometric plane that includes the longitudinal axis of said first elongated shank, and wherein one of said wedge restraint surfaces is perpendicular to every geometric plane that includes the longitudinal axis of said extended shank.

18. The line reel of claim 15, wherein said wedge includes two substantially flat and parallel opposing sides and where each of said opposing sides of said wedge includes at least one of said wedge restraints.

19. The line reel of claim 13, wherein said fastening means includes two prongs extending longitudinally outward from the end of said first extended shank inserted into the spool, said prongs forming a slot between them, further wherein said elongated shank includes a wedge extending longitudinally outward from the end of said elongated shank inserted into the spool, and wherein said wedge is inserted into said slot when both said extended shank and said first elongated shank are inserted into opposite ends of the hollow spool.

20. The line reel of claim 19, further including a prong restraint extending from one of said prongs into said slot, wherein said wedge includes a wedge restraint extending outward from the surface of said wedge, and wherein said prong restraint securely engages said wedge restraint when said wedge is inserted into said slot.

21. The line reel of claim 20, wherein said prong restraint includes two prong restraint surfaces extending from said prong into said slot and forming an acute angle $\psi$ between them at the intersection of said prong restraint surfaces, said wedge restraint includes two wedge restraint surfaces extending outward from said wedge and forming an acute angle $\phi$ between them on the outer surface of said wedge at the intersection of said wedge restraint surfaces, wherein said angle $\phi$ is equal to or greater than said angle $\psi$.

22. The line reel of claim 21, wherein one of said prong restraint surfaces is perpendicular to every geometric plane that includes the longitudinal axis of said first extended shank, and wherein one of said wedge restraint surfaces is perpendicular to every geometric plane that includes the longitudinal axis of said elongated shank.

23. The line reel of claim 22, wherein said wedge includes two substantially flat and parallel opposing sides and where each of said opposing sides of said wedge includes at least one of said wedge restraints.

* * * * *